US007677474B2

(12) United States Patent
Markley et al.

(10) Patent No.: US 7,677,474 B2
(45) Date of Patent: Mar. 16, 2010

(54) SPRINKLER NOZZLE AND FLOW CHANNEL

(75) Inventors: Kevin J. Markley, Vail, AZ (US); Douglas Scott Richmond, Tucson, AZ (US); Steven K. Sharp, Tucson, AZ (US)

(73) Assignee: Rain Bird Corporation, Azusa, CA (US)

( * ) Notice: Subject to any disclaimer, the term of this patent is extended or adjusted under 35 U.S.C. 154(b) by 166 days.

(21) Appl. No.: 11/186,687

(22) Filed: Jul. 21, 2005

(65) Prior Publication Data

US 2007/0029404 A1 Feb. 8, 2007

(51) Int. Cl.
*B05B 1/32* (2006.01)
*B05B 15/10* (2006.01)

(52) U.S. Cl. ..... 239/451; 239/457; 239/458; 239/203

(58) Field of Classification Search ..... 239/451, 239/452, 457, 592, 593, 594, 200–207, 458
See application file for complete search history.

(56) References Cited

U.S. PATENT DOCUMENTS 3,713,584 A * 1/1973 Hunter ..... 239/206
4,796,809 A * 1/1989 Hunter ..... 239/205
5,375,768 A * 12/1994 Clark ..... 239/210
5,456,411 A * 10/1995 Scott et al. ..... 239/73
5,823,440 A * 10/1998 Clark ..... 239/206

OTHER PUBLICATIONS

The Toro Company, 800S Series Sprinklers Brochure, 2003, pp. 1-6.
Rain Bird Corporation, Eagle™ Series Rotors Brochure, pp. 16-17 (depicts products that were sold more than one year prior to the filing date, Jul. 21, 2005).
Rain Bird Corporation, Catalog pages of Eagle 750 Series Rotor, No. 464, pp. 1-2 (depicts products that were sold more than one year prior to the filing date, Jul. 21, 2005).
Rain Bird Corporation, Catalog pages of Eagle 700 Series Rotor, No. 462, pp. 1-2 (depicts products that were sold more than one year prior to the filing date, Jul. 21, 2005).
Rain Bird Corporation, Catalog pages of Eagle 500/550/700/750 Series Rotor, No. 470, pp. 1-2 (depicts products that were sold more than one year prior to the filing date, Jul. 21, 2005).

* cited by examiner

*Primary Examiner*—Davis Hwu
(74) *Attorney, Agent, or Firm*—Fitch, Even, Tabin & Flannery

(57) ABSTRACT

A sprinkler is disclosed for improved flow characteristics. The sprinkler has a sprinkler head rotatably supported for distributing water and defining a flow channel for directing water flow therethrough with reduced head loss. The flow channel has a smoothly tapered portion for receiving water and channeling the water towards an outlet in communication with a first nozzle for distributing the water. The flow channel with reduced head loss produces a greater throw distance at a lower trajectory with a lower flow rate and pressure. The flow channel may be formed within a flow channel member positioned within the sprinkler head. The flow channel member may cooperate with the sprinkler head to define a cavity allowing water to pass through the cavity from the flow channel for emission from a plurality of other nozzles.

19 Claims, 10 Drawing Sheets

SPRINKLER NOZZLE AND FLOW CHANNEL

FIELD OF THE INVENTION

The invention relates to a sprinkler and, more particularly, to a nozzle and flow channel of a sprinkler configured to improve flow characteristics.

BACKGROUND OF THE INVENTION

It is commonly known to use various designs of sprinklers and irrigation systems for various watering applications. Each of these applications typically requires consideration of an emission or flow rate for water distributed to the area, and a distance or area over which the water from a particular sprinkler is distributed. Some particularized applications for sprinkler and irrigations systems require further consideration.

As an example, watering golf courses requires consideration of a greater set of factors. Each of the sprinklers presents an unnatural obstacle that is preferably out of an area of normal play. That is, sprinklers are permanently located at various locations around a golf course. These locations are selected so that, in the normal course of play, most golf balls will avoid the sprinklers and covers placed thereover. As an irrigation network, of which the sprinklers are a part of, may be damaged by excessive weight being placed on the covers, the sprinkler locations are also selected to reduce the likelihood that golf carts are driven over them, as well as pedestrian or golf traffic in general.

Toward the same goal of allowing the sprinkler to be generally avoided by the patrons of a golf course, the number of sprinklers is selected to minimize their number and intrusiveness. However, a typical 18-hole golf course has fairways cumulatively totaling 7000 yards of linear distance or more, not to mention the breadth of the fairways, and areas bounding the fairways commonly known as the rough.

Covering the length and breadth requires distributing or throwing the water a sufficient distance from the sprinklers balanced against minimizing the number of sprinklers. The sprinklers are necessary to provide watering to a variety of verdure, flora and fauna, grass, trees and shrubs, ranging from the azaleas and dogwood trees of Augusta National golf course to the prickly gorse of The Old Course in St. Andrews, Scotland. Watering golf courses, and in particular the watering of fairways, has been performed with sprinklers directing water with a standard trajectory in the range of 20 to 30 degrees above horizontal, and the water is commonly distributed distances of 60 to 100 feet.

While irrigating a farm crop area, the land is generally clear of anything other than the crops. With golf courses, it is common to have trees spread around in an irregular manner, the trees having low-hanging branches. It is also common for golf courses to include other overhanging obstructions. To avoid these obstructions on a golf course, as described, a trajectory lower than the standard trajectory may be used. However, this shortens the distance to which the water can be distributed from the sprinklers. Shortening the distance, then, requires a greater number of sprinklers.

In order to lower the trajectory without increasing the number of sprinklers, a greater throw distance is required. To do so, the water pressure and flow may be increased. Though a higher velocity at the sprinkler nozzle exit is produced, in practice the stream tends to break apart and cause misting, resulting in an imprecise water stream distributed from the sprinkler.

Another issue with golf courses is the careful regulation of the water quantity distributed and the moisture of the various areas. These areas include the fairways, the rough, out-of-bounds, patches of trees or plants, and high and low-lying areas that are affected by run-off more predominantly than other areas. As the areas of a golf course can vary so widely, the irrigation needs of each individual area is specifically planned. Sprinklers are on timers, or automatic sensors may govern the activation and de-activation of various sprinklers.

Nature itself often attempts to wreak havoc on the carefully-designed watering plans. For the most part, the watering plans can be adjusted to compensate for these attempts. Unfortunately, wind is one condition for which it is difficult to plan or compensate. The golf course at Torrey Pines in San Diego, Calif., is located on a bluff overlooking the Pacific Ocean, while the Old Course in St. Andrews is across a beach from the North Sea. Each of these settings subjects their golf courses to a wide range of wind conditions.

Strong winds have a number of negative effects on watering from irrigation sprinklers. In all cases, the wind directs water streams propelled through the air in a downwind direction. In some cases, this results in inappropriate areas receiving water from the stream. In the upwind direction, the stream is unable to distribute water to the proper distances. A water stream under higher pressures, and thus more prone to misting into smaller water droplets, is also more susceptible to effects from the wind as there is an increase in the ratio of wind force on the surface of the droplets and the mass of the droplets.

A lower trajectory for the water stream is less susceptible to wind effects. Wind composed of air, like any other fluid flow, obeys what is known as the no-slip boundary condition. Therefore, the speed or velocity of the wind tends to be lower near the ground surface. In addition, ground structures such as buildings, fences, and trees, reduces the effects of wind close to the ground level.

In summary, there are a number of carefully considered balances in golf course irrigation. A high trajectory for the water stream allows greater distribution distance, but the stream is more susceptible to winds and may be interfered with by trees, for instance, located on the golf course, and a lower trajectory avoiding such obstacles reduces the distribution distance. While a higher-pressured water source may help increase distribution distance, the stream is, again, more susceptible to wind. The number of sprinklers may be increased, but a greater number of sprinklers means a greater number of obstacles to the golf course which can impact or affect the enjoyment of the course by golfers.

Accordingly, there has been a need for an improved sprinkler for efficiently irrigating golf courses or other like areas.

DESCRIPTION OF THE PREFERRED EMBODIMENTS

Figure 1:
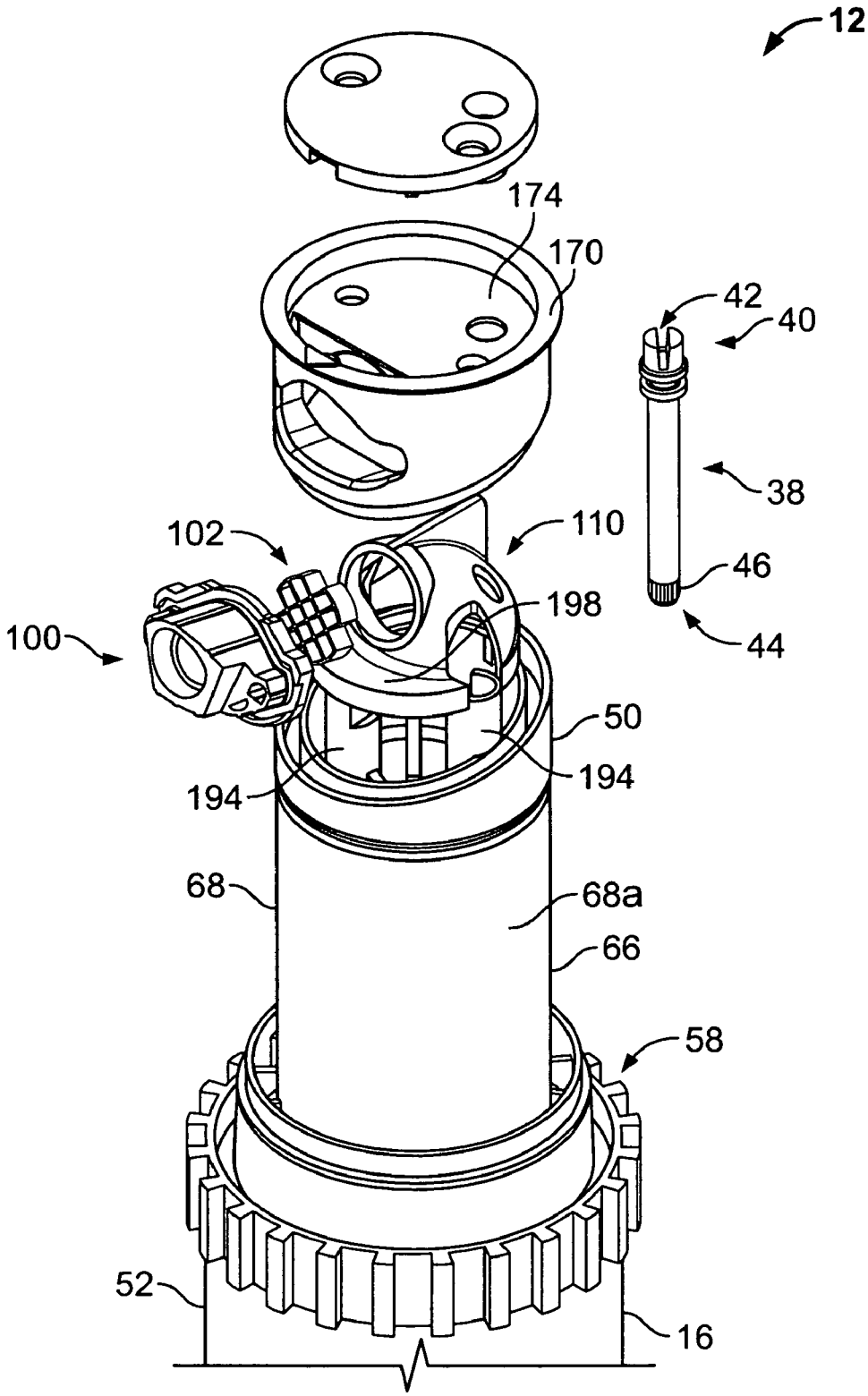
FIG. 1 is an exploded perspective view of a sprinkler head having a flow channel member for directing fluid into a nozzle member, the sprinkler head rotatably supported by a riser.
Figure 2:
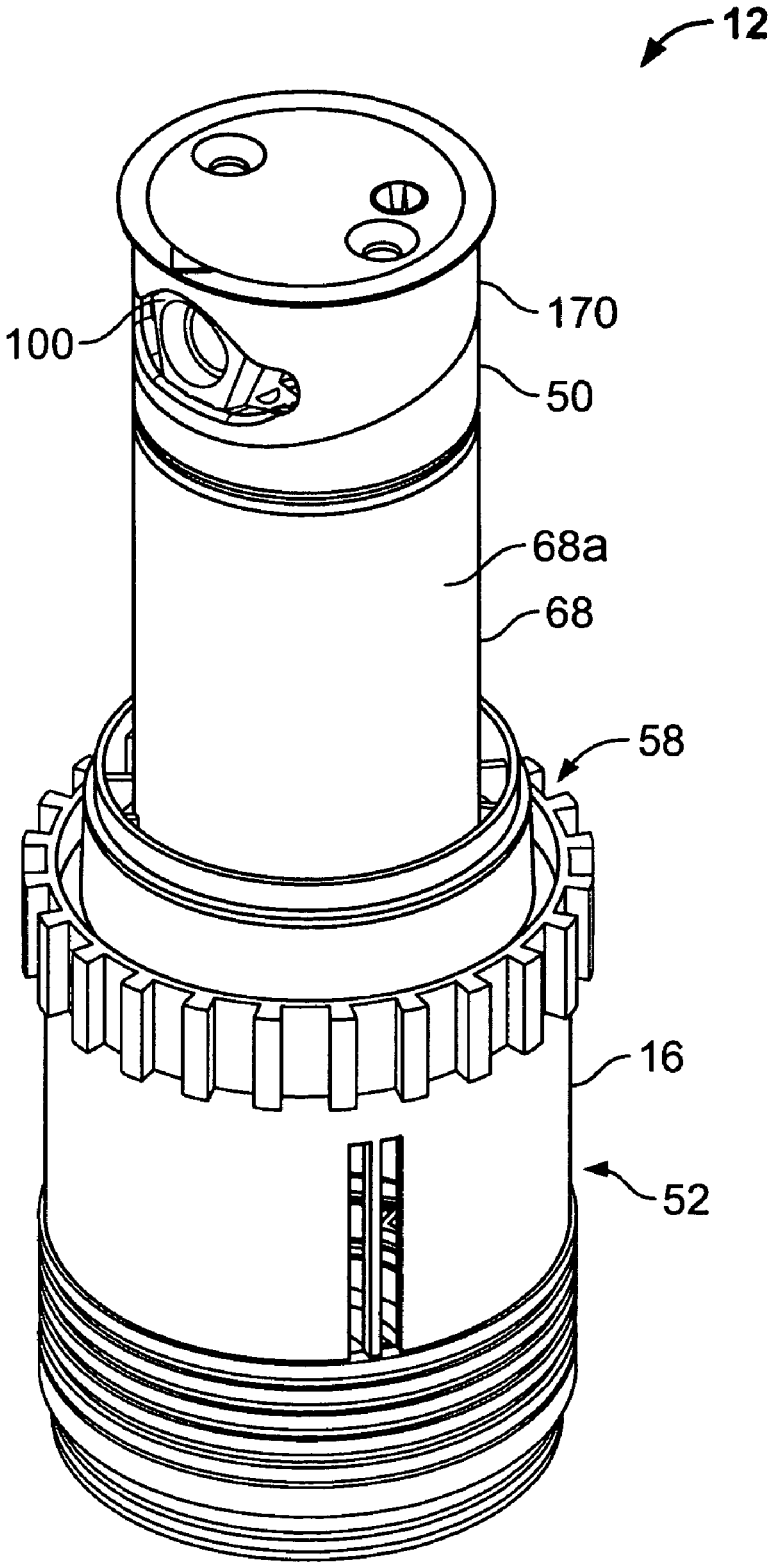
FIG. 2 is a perspective view of the sprinkler head and riser of FIG. 1.
Figure 3:
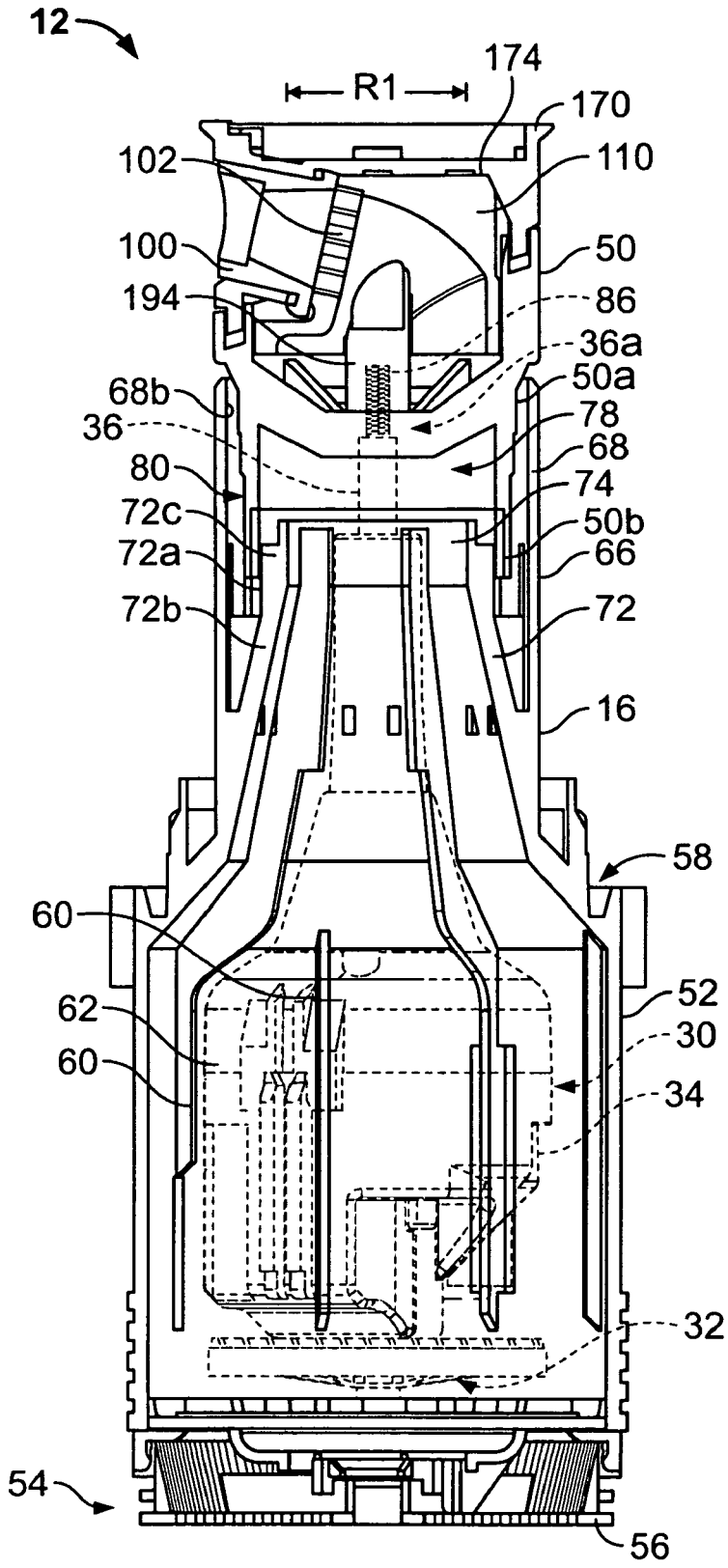
FIG. 3 is a cross-sectional view of the sprinkler head and riser of FIG. 1 showing in phantom a motor for rotatably driving the sprinkler head.

Referring initially to FIGS. 1-3, a sprinkler head 12 of a sprinkler for distributing water in a full or partially radial pattern from a nozzle member 100 in cooperation with a flow channel member 110 is illustrated. The sprinkler includes a stationary housing or case (not shown) within which a movable housing or riser 16 is received. The sprinkler is a pop-up type sprinkler so that the riser 16, as well as the sprinkler head 12 supported thereby, are biased downward within the case by a spring (not shown). When the sprinkler is shut off, the sprinkler head 12 and riser 16 are generally shifted downwardly to a retracted position by the force of the spring and are generally fully received with the case.

The case is typically buried so that a top edge is proximate or flush with a top ground surface. When the sprinkler is activated, water from the water source flows into, and eventually through, the sprinkler. The pressure of the water in the sprinkler overcomes the bias of the spring to force the riser 16 and the sprinkler head 12 upward to an extended position above the ground surface. Water is then distributed from the nozzle member 100 in a selected radial pattern or sweep.

The pressure and flow of the water also provide the sprinkler head 12 with rotational power. As can be seen in FIG. 3, located within the riser 16 is a drive mechanism or motor 30. The motor 30 includes a turbine 32 on its lower end in communication with water flowing through the sprinkler head 12. The water flow contacting the turbine 32 drives the turbine 32 at a relatively high velocity. To reduce the velocity to an appropriate velocity for rotating the sprinkler head 12, a speed-reducing mechanism or drive train is located within the motor housing 34.

The motor 30 communicates with the sprinkler head 12 to effect rotation thereof. The motor 30 includes an output shaft 36 secured with the drive train so as to rotate with an output speed therefrom. The output shaft 36 has an upper end 36*a* secured with the sprinkler head 12 to rotate the sprinkler head 12 with the output speed.

The sprinkler head 12 rotates in a selected radial sweep to distribute water therefrom. The radial sweep is adjusted by a control rod 38 having a top end 40 including structure, such as slot 42, for rotatably adjusting the rod 38. The rod 38 further has a lower end 44 including structure, such as gear teeth 46, for cooperating with a control plate (not shown). The position of the control plate determines the radial sweep, such as between 0 degrees and 360 degrees.

The riser 16 includes a lower body portion 52 having a lower end 54 with which a screen 56 (FIG. 3) is positioned to restrict or prevent particulate matter from flowing into the riser 16. The lower body portion 52 extends upwardly to form a shoulder 58 against which rests a lower end of the spring for biasing the riser 16 downward in the case. The motor 30 is positioned within the lower body portion 52 by radially inwardly extending ribs 60 formed on an inner surface 62 of the riser 16. The ribs 60 allow water to flow around the motor 30 and between the inner surface 62 and the motor housing 34, after the water flows through the turbine 32.

The case and riser 16 cooperate to prevent dirt or particulate matter from entering therebetween from above ground. The case defines a cavity (not shown) in which the riser 16 is received, and the cavity includes a seal (not shown) at an upper portion thereof. The riser 16 has an upper body portion 66 including a cylindrical portion 68 with an outer surface 68*a* that the seal is in sealing contact, regardless of the position of the riser 16 relative to the case. The seal thus prevents entry for sand, dirt or other particulate matter from entering the sprinkler 10 during operation and, particularly, as the riser 16 retracts when the sprinkler 10 is shut off.

The upper body portion 66 of the riser 16 also directs water to the sprinkler head 12. The upper body portion 66 has an interior conical portion 72 angled inwardly as the water flows upwardly therethrough. The conical portion 72 has an upper opening 74 having a radius R1 through which the water flows to the sprinkler head 12.

Figure 4:
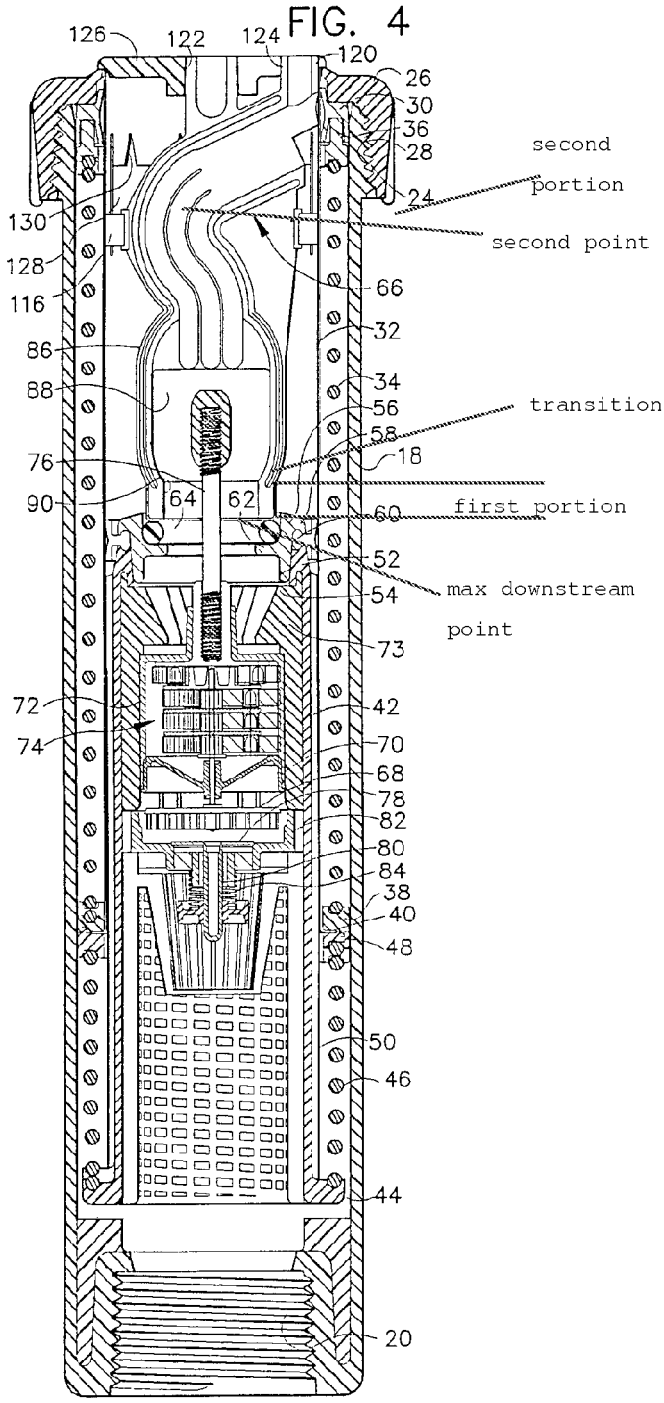
FIG. 4 is a front elevation view of the sprinkler head of FIG. 1.

The sprinkler head 12 has a body 50 rotatably supported by the riser 16. A cavity 78 is defined between the inwardly angled conical portion 72 and the cylindrical portion 68. The sprinkler head body 50 includes a lower cylindrical portion 80 positioned around an exterior surface 72*a* of the conical portion 72 and within an interior surface 68*b* of the cylindrical portion 68. As can be seen in FIG. 4, the lower cylindrical portion 80 of the body 50 is stepped so that an upper portion 50*a* is positioned the cylindrical portion interior surface 68*b* while a lower portion 50*b* is positioned the conical portion exterior surface 72*a*. It should be noted that the conical portion 72 has a generally conical interior shape, as described, though the outside is preferably conical through a lower portion 72*b*, while also having an upper portion 72*c* with a cylindrical configuration on its outside surface for being received within the body lower portion 50*b*.

The output shaft 36 rotates the sprinkler head 12 on the riser 16. The body 50 includes radial ribs 81 joined about a central longitudinal axis of the sprinkler 10 by a hub 82. The hub 82 includes an axially-aligned keyhole 84 with an irregular shape for mating with the output shaft 36. Therefore, the rotation of the output shaft 36 effects co-rotation of the hub 82, the body 50, and the sprinkler head 12.

The output shaft 36 also secures and retains the body 50 on the riser 16. The output shaft 36 has an upper end 86 extending through the keyhole 84. A securement (not shown) that is larger than the keyhole 84 is secured with, such as by threading, the output shaft upper end 86 so that the body 50 and, consequently, the sprinkler head 12 is secured to the output shaft 36 while being rotatable relative to the riser 16.

Water flows through the riser conical portion 72, into the sprinkler head body 50, and between the ribs 81. The water flow is then channeled through the sprinkler head 12 and emitted from the nozzle member 100. More specifically, the water flow between the ribs 81 is channeled by the flow channel member 110, which focuses the water flow through a grid 102 located at the flow channel member 110, and is emitted from the nozzle member 100.

Figure 14:
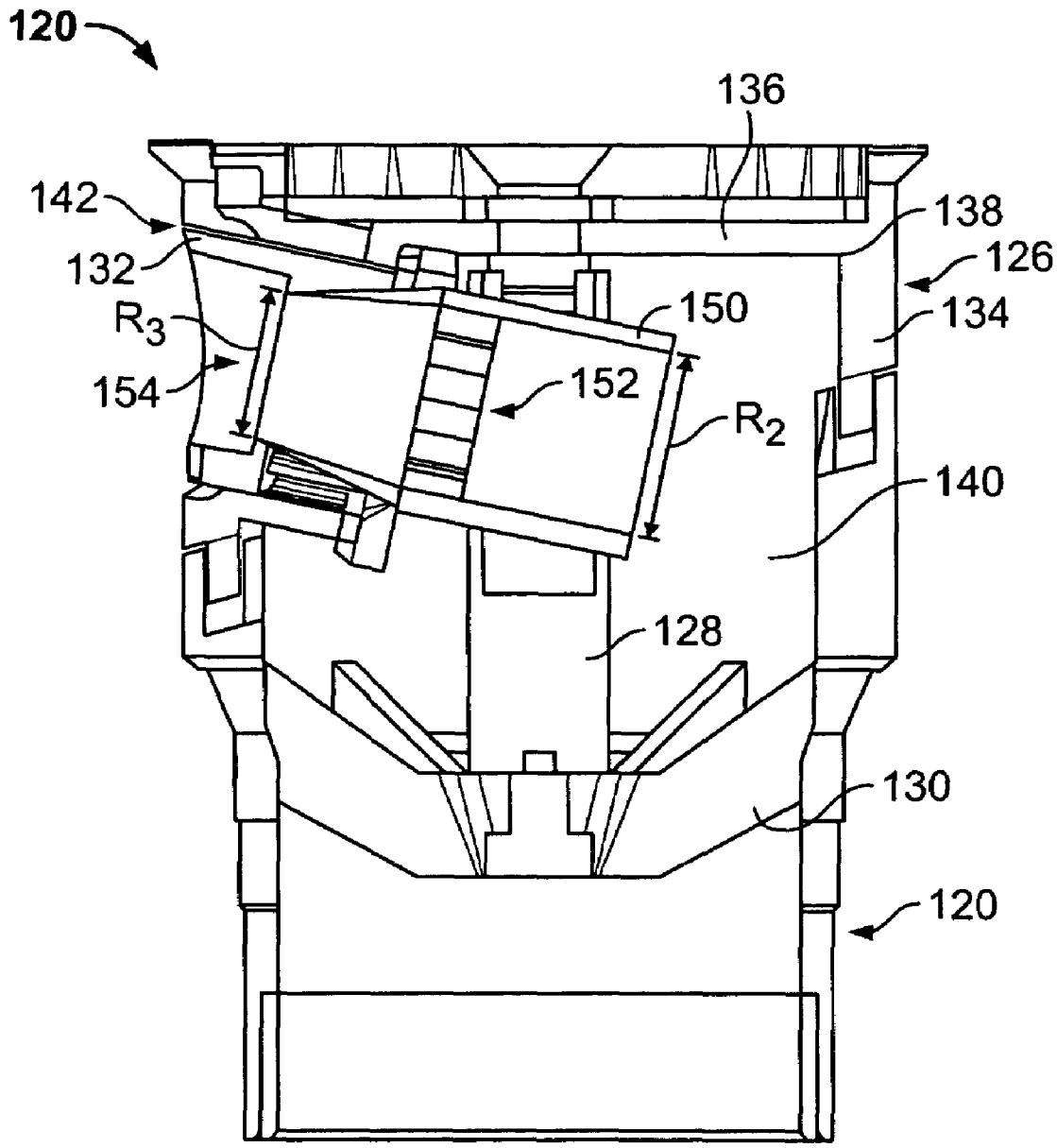
FIG. 14 (Prior Art)
FIG. 14 is a cross-sectional view of a prior art sprinkler head.

With reference to FIG. 14, a sprinkler head 120 of the prior art is illustrated. The sprinkler head 120 is secured with and rotatably supported by a riser in the same manner as the above described sprinkler head 12 and riser 16. As can be seen, the sprinkler head 120 includes a body 124 and a cap 126. The body 124 includes a pair of posts 128 (one shown) extending upwardly and parallel to the axis of rotation of the sprinkler head 120. The posts 128 are secured or formed integral with ribs 130 located in the water flow path, generally identical to the ribs 81 described-above. Fixation members such as screws are inserted through the cap 126 and are received by the posts 128 to secure the cap 126 with the body 124.

The water flows between the ribs 130 and into the cap 126 for emission from a nozzle member 132. The cap 126 is generally cylindrical such that it has a cylindrical wall 134 and a top wall 136 orthogonal to the cylindrical wall 134. In general, the cylindrical and top walls 134, 136 form a right angle therebetween, such as at 138. The water flows into a cavity 140 defined by the cylindrical and top walls 134, 136 and, then, is forced through the nozzle member 132.

The nozzle member 132 is secured with and extends through an opening 142 defined by the cap 126. The nozzle member 132 includes a cylindrical feed portion 150 extending into the cavity 140 and towards the water flow. Within the feed portion 150 is a grid 152 which assists in collimating the water flow. The water passes through the grid 152 and exits through a nozzle 154 formed in the nozzle member 132. Specifically, the nozzle 154 is frustoconically-shaped having a larger inlet radius R2 than exit radius R3.

As water flows into the cavity 140 of the prior art sprinkler head 120, there is significant pressure or head loss. The flow of water within the sprinkler head 120 is generally uncontrolled. The head loss limits the performance of the prior art sprinkler head 120. For instance, the nozzle 154 is typically given an output trajectory between 20 and 30 degrees, and is typically fed with a high water pressure and flow rate, in order to achieve desirable throw distances in the range of 60-100 feet.

As discussed above, it is preferable to operate a sprinkler at a lower trajectory, which requires increasing the water pressure and flow rate to the prior art sprinkler head 120. With a nozzle trajectory of 12 degrees, the prior art sprinkler head 120 is generally capable of throwing water 55-60 feet for flow rates between 24 and 28 gallons per minute. As another more specific example, the prior art sprinkler 120 with a nozzle trajectory at 10 degrees and 70 psi requires 19.7 gallons per minute of flow to throw the water 52 feet.

High water high pressure and flow rates have a number of drawbacks. First, high pressure and flow rates place significant stress on the irrigation network, as well as each individual sprinkler. In addition, the nozzle member 132 does not effectively direct the water without causing misting, which is more susceptible to being blown or carried by wind away from the desired watering area.

Figure 5:
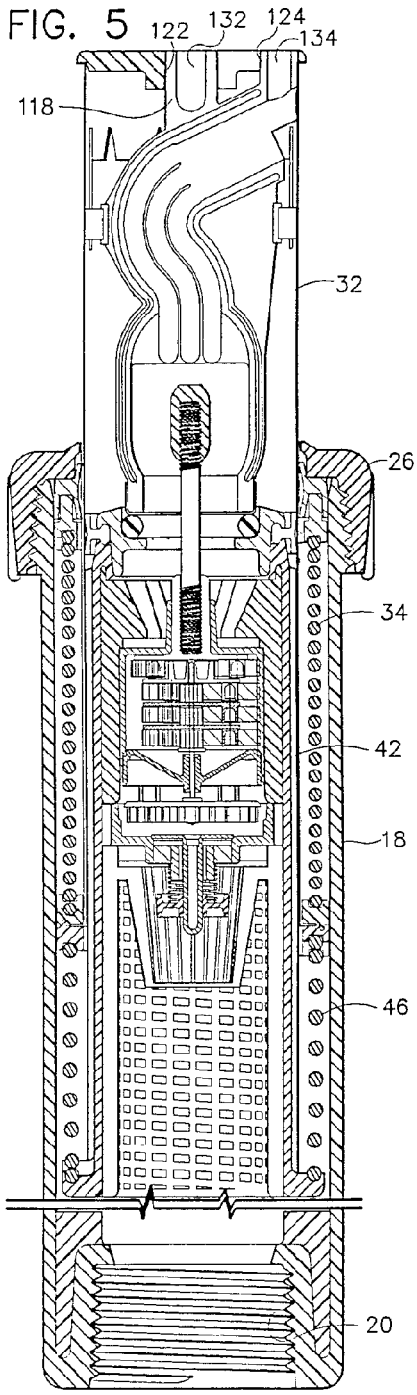
FIG. 5 is a cross-sectional view of the sprinkler head of FIG. 1.

The sprinkler head 12 described herein allows a greater throw distance at a lower flow rate. In order to do so, the sprinkler head 12 utilizes the flow channel member 110, cooperating with the nozzle member 100, for reducing head loss within the sprinkler head 12. As can be seen in FIG. 5, the sprinkler head 12 includes a cap 170 formed of a generally cylindrical wall 172 and a transverse or orthogonal top wall 174. The cap 170 and the body 50 define a cavity 176 above the ribs 81. The flow channel member 110 is positioned within the cavity 176 for guiding and transitioning the water flow into the nozzle member 100, as will be discussed.

The flow channel 110 is supported by the body 50. The body 50 has an interior surface 180 including a circumferential shoulder 182 immediately above the ribs 81 and extending a short distance inwardly. The flow channel 110 has a generally circular bottom edge 184 resting on the shoulder 182 when the sprinkler head 12 is assembled.

Figure 6:
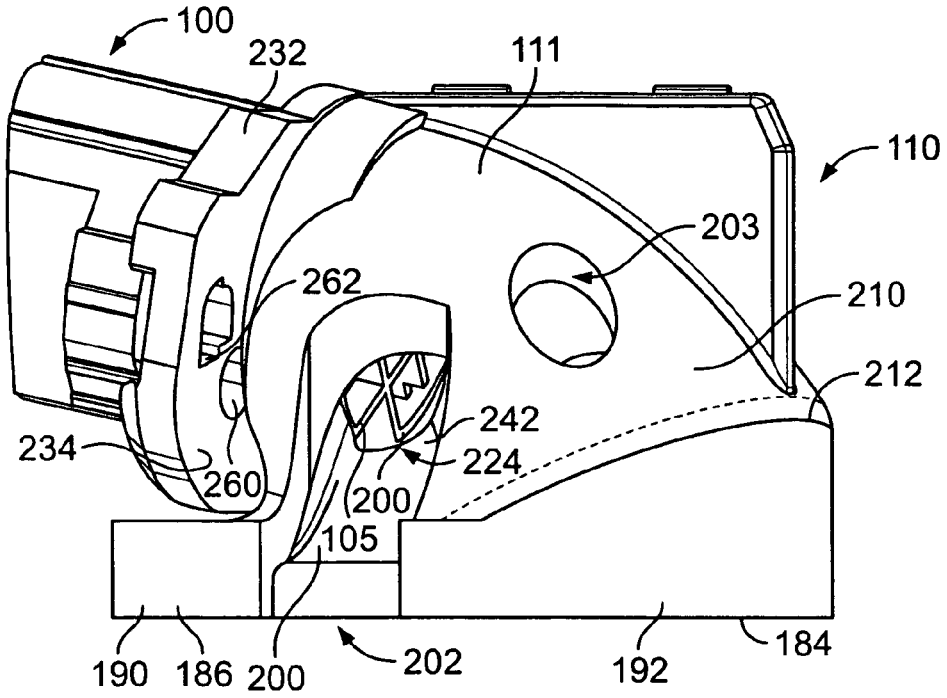
FIG. 6 is a perspective view of the flow channel member and nozzle member of FIG. 1.
Figure 7:
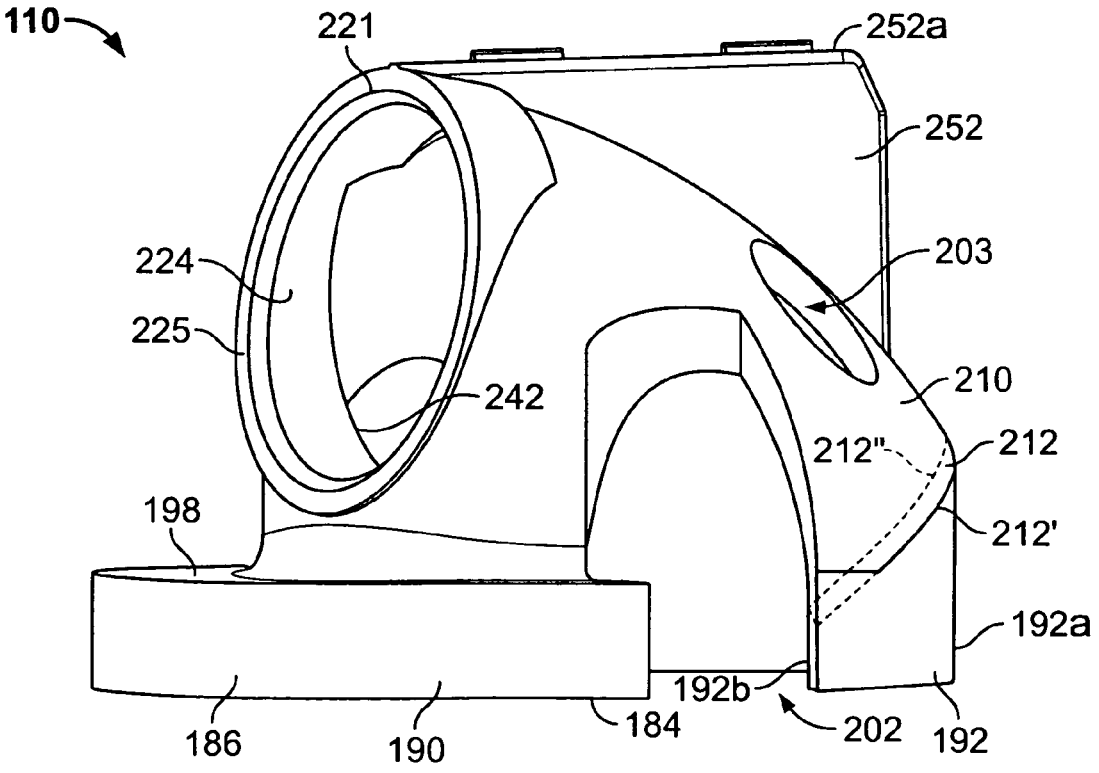
FIG. 7 is a perspective view of the flow channel member of FIG. 1.
Figure 8:
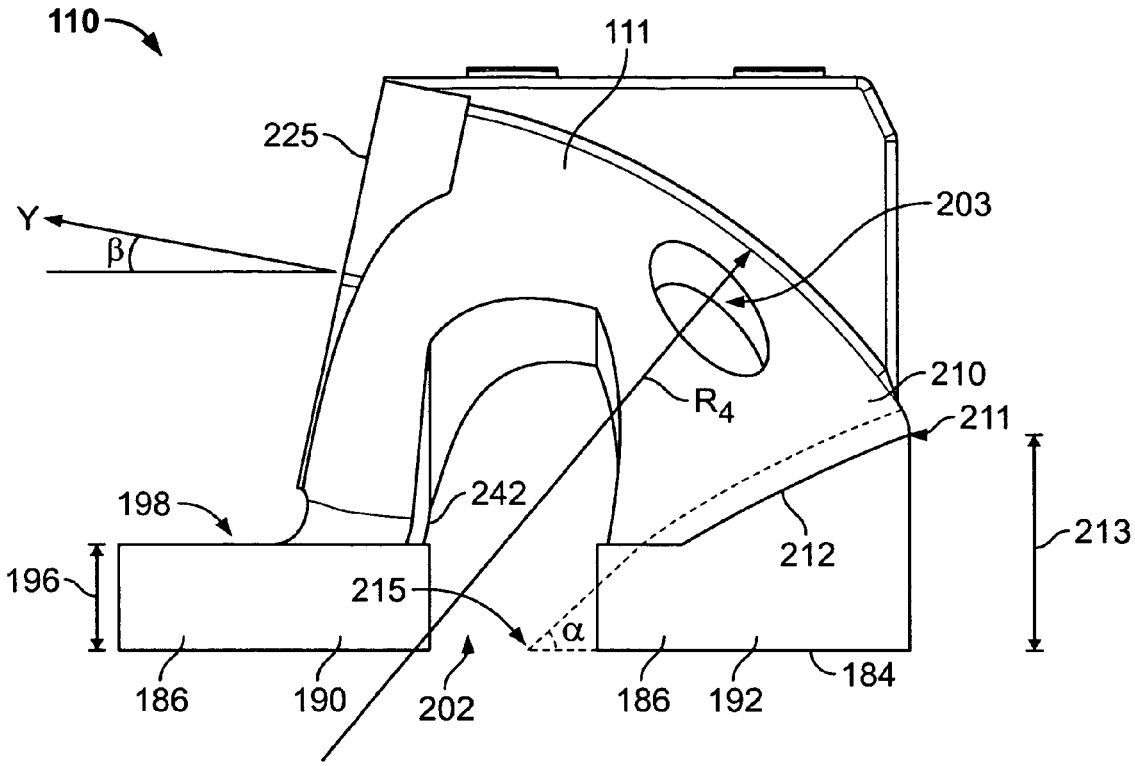
FIG. 8 is a side elevational view of the flow channel member of FIG. 1.

Referring now to FIGS. 6-12 illustrating the flow channel member 110, the bottom edge 184 is located on a lower cylindrical section 186 of the flow channel 110. In this manner, the majority of the flow through the body 50 and between the ribs 81 is initially captured by the flow channel member 110. With particular reference to FIG. 8, the lower cylindrical section 186 forms a front section 190 and a rear section 192. The cap 170 is secured with the body 50 via screws passing through the cap 170 to be secured with posts 194 (FIG. 1) extending upwardly from the ribs 81 parallel to the axis of rotation and in the water flow path. In order to provide for the posts 194, the flow channel member 110 includes a pair of cut-outs 202 generally diametrically opposed through which the posts 194 pass. The cut-outs 202 are positioned so as to span across the sectioning between the front and rear sections 190, 192.

Alternatively, the cap 170 may be secured with the body 50 in any other suitable manner, such as with an adhesive or welding, so that the posts 194 are not present. In this event, the cut-outs 202 would not be necessary, and a demarcation between the front and rear sections 190, 192 would be at along a line 212, as will be discussed below. The flow channel member 110 further defines a throughbore 203 for allowing the above-described control rod 38 to pass therethrough.

The cylindrical front section 190 rises from the bottom edge 184 a relatively short height 196 (FIG. 8) that is generally constant along the entire front section 190.

The cylindrical front section 190 terminates in an upper wall 198 for channeling the water received thereagainst. As water flows upwardly from the body 50, the water entering at the front area of the flow channel member 110 is guided by the upper wall 198 rearward and around the upper wall section 198 and further into the flow channel member 110. To ease this re-direction and to minimize head loss, the front section 190 and the upper wall section 198 form a curved or smoothly radiused edge 200 (FIG. 5). Once the water has flowed around the edge 200, it is free to flow upwardly in the flow channel member 110 and, eventually, through the nozzle member 100.

Figure 10:
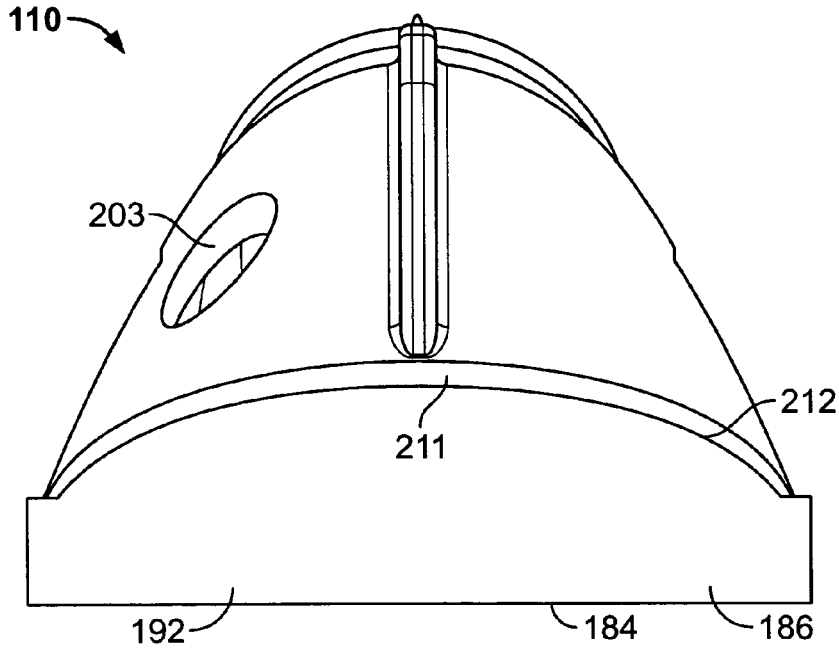
FIG. 10 is a rear elevational view of the flow channel member of FIG. 1.
Figure 11:
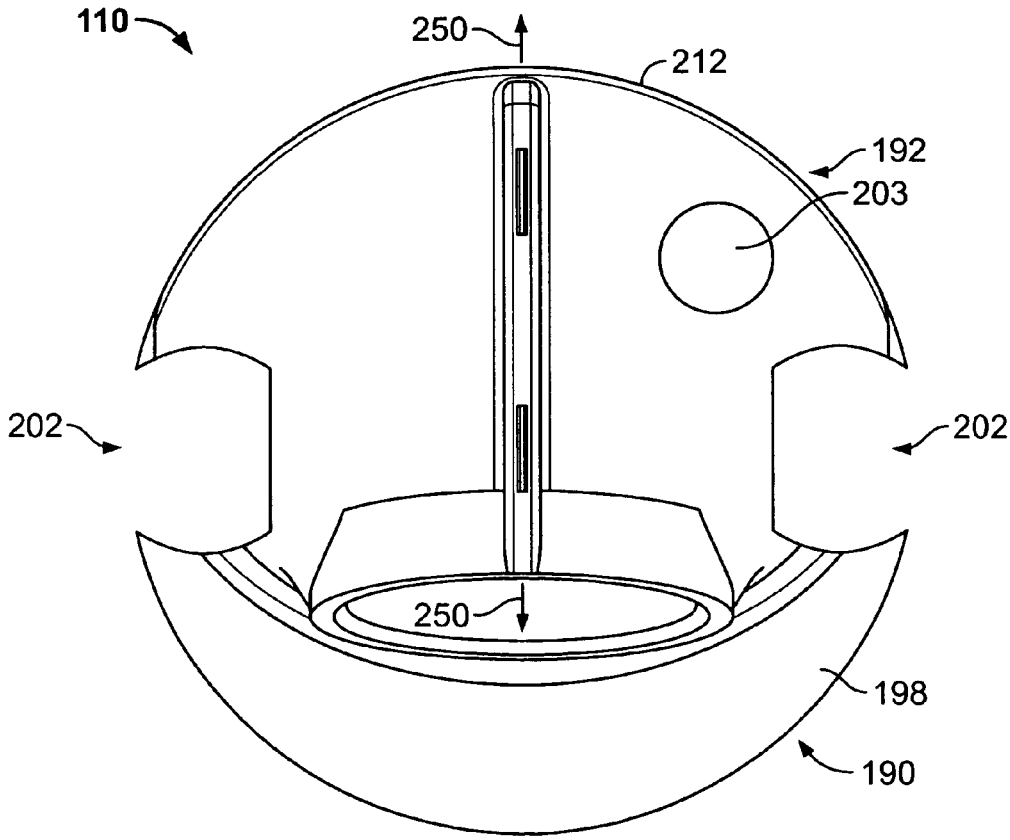
FIG. 11 is a top plan view of the flow channel member of FIG. 1.

The cylindrical rear section 192 rises a distance from the bottom wall edge 184, though the distance varies around the circumferential extent of the cylindrical rear section 192. More specifically, the cylindrical rear section 192 transitions into a tapered section 210. The rear section 192 and tapered section 210 are joined along an arced line or portion 212. With reference to FIGS. 8 and 10, the line 212 has a rear-most point 211 which is at a maximum height 213 for the line 212 from the generally horizontal bottom edge 184.

As noted above, the flow channel member 110 reduces the head loss experienced by water as it flows through the sprinkler head 12 generally and, more particularly, through the cap 170. In general, the tapered section 210 allows for a smooth transition between the generally vertically flowing and collimated water through the sprinkler head 12 and the nozzle member 100 emitting the water in an exit trajectory, angle β above horizontal (FIG. 8). As noted, the prior art sprinkler head 120 having the cavity 140 defined by the cap 126 provides this transition with significant head loss. The tapered section 210 provides this turn and channels the water towards the nozzle member 100, and it does so with a reduced head loss from the sprinkler head 120.

Figure 12:
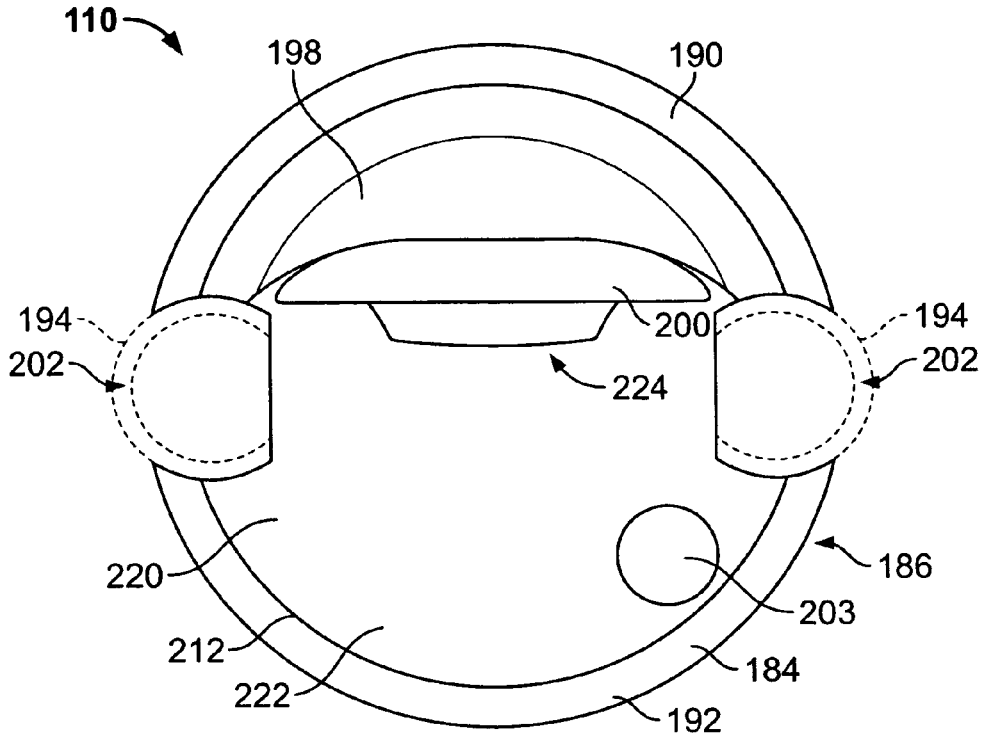
FIG. 12 is a bottom plan view of the flow channel member of FIG. 1.
Figure 13:
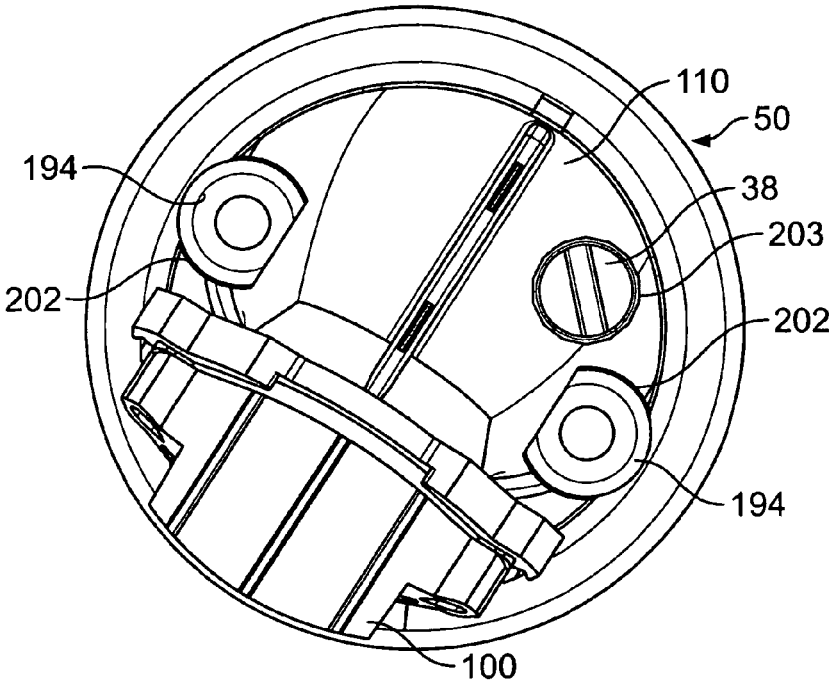
FIG. 13 is a top plan view of the nozzle member and the flow channel member assembled in the riser of FIG. 1.

The tapered section 210 is generally a combination of a tapered tube and an elbow pipe to define a flow channel 220 through the tapered section 210. Consequently, the tapered section 210 is generally arcuately shaped in the direction of water flow, such as along line 250, discussed below, as well as in directions transverse to the direction of water flow and circumferentially around the water flow. As seen in FIG. 12, the flow channel 220 has an inlet 222 communicating with the region bound by the lower cylindrical section 186. The inlet 222 is defined by the cylindrical rear section 192 along the line 212, the rounded inner edge 200 of the upper wall section 198, and a portion of the posts 194. The posts 194 have an insignificant impact on the flow at the inlet 222 so as not to reduce the performance of the nozzle.

Figure 9:
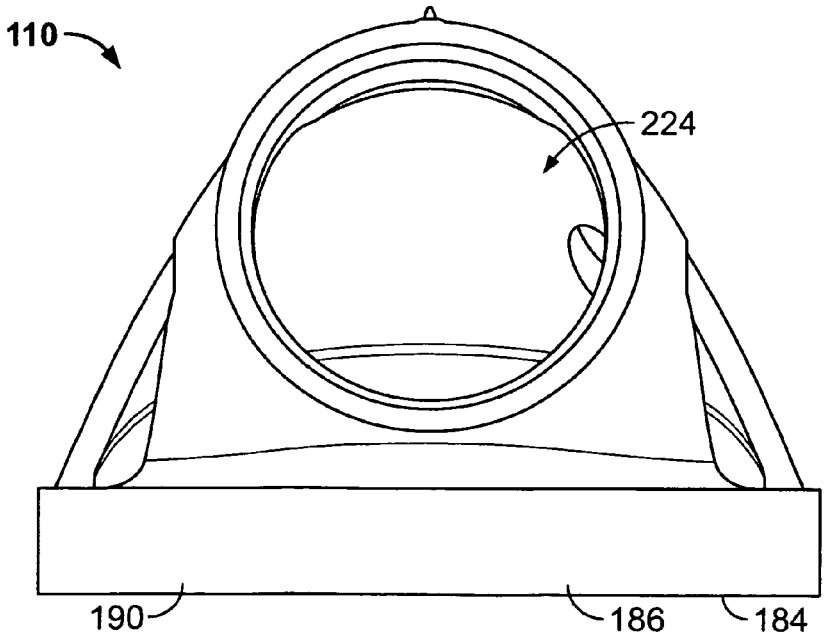
FIG. 9 is a front elevational view of the flow channel member of FIG. 1.

As seen in FIGS. 8 and 9, the flow channel 220 defines an outlet 224. The outlet 224 is essentially a cylindrical port bound by an outlet wall 225 having a central axis γ (FIG. 8) preferably at the trajectory angle β. As illustrated in FIGS. 4 and 5, the grid 102 is positioned within the outlet 224. The grid 102 preferably defines an array of generally square openings 226 having a height and width of approximately 0.10 inches. The openings 226 are truncated at the edges of the grid 102 to provide the grid 102 with a circular outer perimeter to match the shape of the outlet 224. It is preferred that cross-pieces 103 of the grid 102 have small leading edges 105 directed towards the water flow into the grid 102 and from the flow channel 220 to minimize disturbance to the water. The cross-pieces 103 may taper inwardly in the direction of flow so that the water accelerates therethrough.

The outlet 224 is sized to correspond to a nozzle 230 formed in the nozzle member 100. As can be seen in FIGS. 5 and 6, the nozzle member 100 has a body 232 having a rear side 234 positioned flush against the outlet wall 225. In comparison to the prior art sprinkler head 120, the feed portion 150 has been eliminated for the nozzle member 100. The body 232 includes the nozzle 230 which, like in the prior art sprinkler head 120, is generally a conical frustum tapering inward from a nozzle inlet 236 to a nozzle outlet 238.

As stated above, the preferred flow channel member 110 is generally similar to a combination of an elbow pipe and a tapered tube. For instance, the tapered section 210 angles forward from the cylindrical rear section 192, and tapers inward towards the outlet 224. As the upper wall section 198 curves upward, it joins with an outlet wall 242, as can be seen in FIG. 7, and within which the grid 102 is received. The outlet 224 is defined by the outlet wall 242, which is generally planar though it may also have an interior contour so that the interior surface slopes inwardly in a region surrounding the outlet 224 and in a direction of water flow through the outlet 224.

Generally, the flow channel member 110 reduces head loss and channels the water into the nozzle member 100. It is known that a smooth or gradual change of direction for flowing fluid results in lower head loss than does a sharp change in direction. It is also known that constriction of fluid flow results in a head loss. Accordingly, the design of the flow channel member 110 may be enhanced through the use of smoother transitions such as rounded edges and tapered surfaces, as opposed to sharp transitions. One aspect to note is that increasing the curve of a sharply turned portion may produce a head loss from constriction of the flow path that is greater than the head loss benefit achieved by increasing the curve.

The preferred flow channel member 110 balances smoothing of contours for the flow path 220 with resulting constriction that optimizes the flow path 220 for minimal head loss. For instance, the line 212 between the tapered section 210 and the cylindrical rear section 190 creates a relatively sharp contour for the water to flow over. Complete elimination of this line 212, in which the height 213 is zero, however would result in the inlet 222 being horizontal and generally coincident with the bottom edge 184. In such an instance, the water flow would experience less head loss through the region where the line 212 would otherwise be; however, this results in a narrowing of the flow path 220 that increases the head loss in a greater amount than the amount of head loss saved by the smooth contour.

The height 213 is selected to balance these factors. In general, any contouring of the flow path 220 provides a performance benefit. As seen in FIG. 8, the line 212 may be extended forward to an imaginary point 215 intersecting with the horizontal to form an angle α. It is preferred that the height 213 be such that the angle α be approximately 45 degrees or less and even more preferably between 5 and 20 degrees.

As discussed above, the tapered section 210 transitions between the outlet wall 242, the upper wall section 198, and the rear wall section 192 along the line 212. As can be seen in FIG. 7, the tapered section 210 and the rear wall section 192 have respective wall thicknesses so that their intersection forms the line 212. Due to these wall thicknesses, the line 212 includes a rear boundary 212' along an outer surface 192*a* of the rear section 192 and a front boundary 212" along the interior surface 192*b*. An absence of the cut-outs 202 would allow the boundaries 212' and 212" to continue to the horizontal and intersect with the bottom surface 184, at the angle α (FIG. 8).

The height 213 determines where the intersection point 215 would be formed, in terms of position and angle α between the line 212 and the plane of the bottom edge 184. More specifically, the height 213 determines a radius of curvature R4 (FIG. 8) for an arcuate central line 250 (FIG. 11), which is the portion of the tapered section 210 with the greatest radius of curvature therethrough. The central line 250 spans generally from the rear-most point 211 to an uppermost point 221 (FIG. 7) proximate the outlet 224. A greater radius of curvature R4 results in decreased head loss through the tapered section 210, while a sharper transition from the cylindrical section 186 leads to increased head loss at the juncture. Increasing radius of curvature for the central line 250 also increases the height 213. A dorsal-type fin 252 is extends along the central line 250, and the fin 252 is used to assist in positioning the flow channel member 100 within the cap 170, as well as to resist the flow channel member 100 moving upward when water flows thereagainst because it has an upper edge 252*a* that can engage the cap 170.

The line 212 is formed at the transition from the cylindrical shape of the lower cylindrical portion 186 and the tapered elbow pipe shape of the tapered section 210. Therefore, increasing the radius of curvature R4 correspondingly generally increases a radius of curvature along other portions of the tapered section. Thus, the line 212 between the tapered section 210 and the cylindrical portion 186 will shift upward so that the intersection point 215 at which the line 212 crosses the horizontal plane with the bottom surface 184 will correspondingly shift rearward, towards the rear-most point 211. Therefore, angle α will increase for a greater height 213. Conversely, lowering the height 213 is achieved by decreasing the radius of curvature for portions of the tapered section 210, thereby constricting the passage 220 through the tapered section 210 while reducing the sharpness of the transition along boundary 212". Thus, the intersection point 215 moves forward, towards the front cylindrical wall portion 190, decreasing the angle α.

With reference to FIGS. 4 and 6, the nozzle member 100 provides a plurality of emission streams. The nozzle member 100 emits water as a primary stream from the generally centrally located nozzle 230 for maximum throw distance. In order to distribute water at distances short of the maximum throw distance, the nozzle member 100 also has one or more short nozzles 260 for distributing water to short distances, and one or more intermediate nozzles 262 for distributing water to intermediate distances. These nozzles 260, 262 are fed by designed leakage around or through the flow channel member 110.

More specifically, the flow channel member 110 defines a number of openings for various construction purposes. The flow channel member 110 includes the opening 203 for the control rod 38, and includes the cut-outs 202 for the posts 194 for attaching the cap 170 via fasteners or screws. Each of these is permitted to leak, and is not fashioned as to be sealed. Accordingly, a relatively small portion of the water flowing into the flow channel member 110 from the body 50 leaks outside of the flow channel member 110.

This designed leakage supplies water to the short and intermediate nozzles 260, 262. The flow channel member 100 serves to divide the cavity 176 into the flow path 220 through the flow channel member 100 and a cavity 264 (FIG. 5) between the cap 170 and an outer surface 111 of the flow channel member 100. This provides a region that is generally isolated or distinct from the speed of the water flowing through the flow channel member 100, and a negative pressure produced by its related Bernoulli's effect. This isolation reduces the negative pressure effect in the region of the nozzles 260, 262, which might otherwise cause aspiration or drawing-in of air from the environment.

Figure 15:
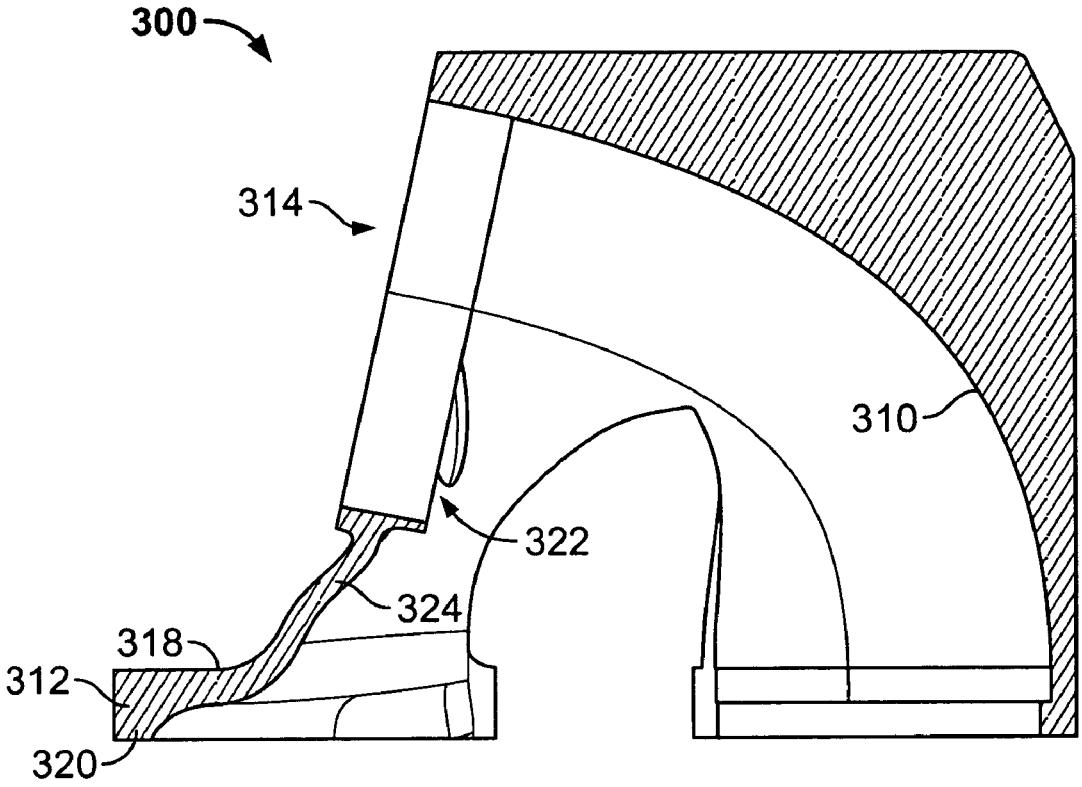
FIG. 15 is a cross-sectional view of an alternative flow channel member.

With reference to FIG. 15, an alternative flow channel member 300 is depicted having a tapered section 310 and a lower cylindrical entrance section 312. As noted above, the angle $\alpha$ may be altered to adjust the amount of head loss by constriction and by a transition between the tapered section 310 and the entrance section 312. Viewed another way, the height 213 of the above-described flow channel member 100 may be adjusted so that the angle $\alpha$ and intersection point 215 are adjusted.

For the flow channel member 300, the angle $\alpha$ has been decreased to zero degrees. The flow channel member 300 includes an outlet 314, which preferably receives therein a grid substantially similar to grid 102. The radius of curvature for the flow channel member 300 is decreased to provide for the angle $\alpha$ of zero degrees. Accordingly, the constriction on water flow through the tapered section 310 is increased, in comparison to the above-discussed flow channel member 100. However, the flow channel member 300 does not have a transition line such as the above-discussed transition line 212.

In further comparison with the flow channel member 100, the flow channel member 300 has a top wall 318 joining with a front cylindrical wall section 320 to direct flow around to a nozzle opening 322. The top wall 318 joins with an outlet wall 324 to form a relatively smooth path for the water flow through the region proximate and below the nozzle opening. The front wall section 320, the top wall 318, and outlet wall 324 thus provide a smoother path for water to flow along, thus reducing head loss.

The sprinkler head 12 utilizing the flow channel members 100, 300 benefit from improved watering and flow characteristics. For instance, the sprinkler head 12 may be operated at 70 psi having a nozzle trajectory of 10 degrees. When used with the flow channel member 100 having an angle $\alpha$ of 12 degrees, the sprinkler head 12 delivers water a distance of 64 feet with a flow rate of 19.2 gallons per minute. When used with the flow channel member 300, angle $\alpha$ being zero degrees, water is emitted a distance of 60 feet with a flow rate of 19.2 gallons per minute. Under the same parameters, the prior art sprinkler 120 throws water only 52 feet and requires a flow rate of 19.7 gallons per minute. In order to achieve 64 feet of throw distance, the prior art sprinkler 120 requires a flow rate of 20.4 gallons per minute and a trajectory of 25 degrees. In a representative embodiment, the lower cylindrical wall 186 has an approximate inner diameter of 1.185 inches at the entrance to the inlet 222, the outlet wall 242 is positioned on a horizontal line approximately 0.757 inches from the rear wall portion 192, and the diameter of the outlet 224 is approximately 0.599 inches.

While the invention has been described with respect to specific examples, including presently preferred modes of carrying out the invention, those skilled in the art will appreciate that there are numerous variations and permutations of the above described devices and methods that fall within the spirit and scope of the invention as set forth in the appended claims.

What is claimed is:

1. A sprinkler for distributing water to an area, the sprinkler comprising:

a housing having a longitudinal central axis;

a flow path for directing water through the sprinkler;

a drive mechanism having a portion located in the flow path for producing rotational power;

a sprinkler head operably coupled with the drive mechanism and rotatably supported by the housing, wherein the sprinkler head includes a flow channel for directing water from the flow path to a nozzle for discharge from the sprinkler, the flow channel having an inlet, an outlet, a first portion being generally cylindrical and having an upstream edge defining the inlet, and a second portion being generally arcuately shaped and smoothly tapered toward the outlet; and a transition between the first portion and the second portion defining a line and including a first maximum downstream point for the first portion, the line capable of being extended to form a predetermined acute angle relative to a plane containing the inlet;

wherein the first portion and the second portion combine to define a non-tortuous guide wall portion extending between the inlet and the outlet and guiding the flow in a changing angular direction where the changing angular direction includes an angle relative to the central axis that always increases in the same direction.

2. The sprinkler of claim 1 wherein the outlet includes a second maximum downstream point for the second portion, the arcuate shape of the second portion between the first and second maximum downstream points defining a predetermined radius of curvature for at least part of the second portion.

3. The sprinkler of claim 1 wherein the sprinkler has a nozzle trajectory of less than 15 degrees above the horizontal.

4. The sprinkler of claim 1 wherein the predetermined acute angle is greater than 0 degrees and less than or equal to 45 degrees.

5. The sprinkler of claim 4 wherein the angle is between 5 and 20 degrees.

6. The sprinkler of claim 1 wherein the flow channel further includes a front wall portion at least in part defining the inlet opening, a top wall portion spanning at least a portion of the front wall portion, the front wall and top wall portions cooperating to direct water towards the flow channel outlet.

7. The sprinkler of claim 6 wherein the flow channel further includes an outlet wall defining the flow channel outlet, and the outlet wall and front wall portion are joined at a smoothly radiused edge.

8. A sprinkler for distributing water to an area, the sprinkler comprising:

a support housing having a longitudinal central axis;

a flow path for directing water through the sprinkler;

a drive mechanism having a portion located in the flow path for producing rotational power;

a sprinkler head operably coupled with the drive mechanism and rotatably supported by the support housing, wherein the sprinkler head includes a head housing including a nozzle, and a flow channel for directing water from the flow path through the nozzle, the flow channel having an inlet, an outlet in communication with the nozzle, and at least a portion being generally arcuately shaped and smoothly tapered between the inlet and outlet;

a rear wall portion upstream from the tapered portion and at least in part defining the inlet opening;

an imaginary cross-section plane through the flow channel angling downstream from the inlet and transitioning the downstream tapered portion from the upstream rear wall portion;

wherein the flow channel inlet defines a generally planar opening, the imaginary plane being angled downstream at a predetermined angle relative to the generally planar opening;

wherein the intersection of the rear wall portion and the imaginary plane define a first point that is a first predetermined distance downstream from the inlet plane, the flow channel outlet defines a second point that is a second predetermined distance downstream from the inlet plane, and the first and second points define a predetermined radius of curvature for the tapered; and wherein the rear wall portion and the tapered portion combine to define a non-tortuous guide wall portion extending between the inlet and the outlet and guiding the flow in a changing angular direction where the changing angular direction includes an angle relative to the central axis that always increases in the same direction.

9. The sprinkler of claim 8 wherein the head housing includes:

a lower portion for cooperating with the support housing, and an upper portion including the flow channel, wherein the flow channel and the lower portion define a cavity for receiving water from the support housing and directing the water to the flow channel outlet.

10. The sprinkler of claim 9 wherein the head housing and flow channel define a second cavity.

11. The sprinkler of claim 9 wherein the flow channel is defined by a flow channel member positioned within the head housing.

12. The sprinkler of claim 11 wherein the flow channel member has an outer surface, and the outer surface and head housing define a cavity therebetween.

13. A sprinkler for distributing water to an area, the sprinkler comprising:

a housing having a flow path for receiving water from a water source and having a longitudinal central axis and the flow path having an outlet;

a sprinkler head rotatably mounted on the housing and having a nozzle for distributing water;

a drive mechanism operably coupled with the sprinkler head and having a portion located in the flow path for producing rotational power for rotating the sprinkler head;

the sprinkler head defining a flow channel for receiving water in a first general direction from the housing flow path and for channeling the water from the first general direction to a second direction generally aligned with the nozzle;

a flow channel member for guiding water flow into the nozzle and for reducing energy loss experienced by water flowing in the flow channel, the member including an open inlet end generally aligned with the outlet of the flow path, a rear wall portion downstream from the inlet, and a tapered portion downstream from the rear wall portion and defining an outlet of the flow channel member;

a break plane angling downstream from the inlet opening and dividing the downstream tapered portion from the upstream rear wall portion;

wherein the flow channel inlet defines a substantially planar opening;

wherein the intersection of the rear wall portion and break plane define a first point that is a first predetermined maximum height from the inlet plane, the flow channel outlet defines a second point that is a second predetermined maximum height from the inlet plane, and the first and second points define a predetermined radius of curvature for the tapered; and wherein the rear wall portion and the tapered portion combine to define a non-tortuous guide wall portion extending between the inlet and the outlet and guiding the flow in a changing angular direction where the changing angular direction includes an angle relative to the central axis that always increases in the same direction.

14. The sprinkler of claim 13 wherein the tapered portion tapers inwardly in a downstream direction of water flow.

15. A sprinkler for distributing water comprising:

a housing having a longitudinal central axis;

a drive mechanism for producing rotational power; and a sprinkler head operably coupled to the drive mechanism and rotatably supported by the housing and including a flow channel member having an inlet and outlet and defining a flow channel therebetween;

the flow channel member having an upstream portion and a downstream portion;

the upstream portion including an upstream edge defining the inlet and a cylindrical rear wall section that extends downstream a first distance from the upstream edge and that defines a predetermined circumferential extent, the first distance varying about the circumferential extent to form an arced transition portion with the downstream portion; and the downstream portion including a tapered profile being arcuate in both the direction of the water flow and transverse to the direction of water flow and terminating with a downstream edge forming the outlet;

wherein the upstream portion and the downstream portion combine to define a non-tortuous guide wall portion extending between the inlet and the outlet and guiding the flow in a changing angular direction where the changing angular direction includes an angle relative to the central axis that always increases in the same direction.

16. The sprinkler of claim 15 wherein the arced transition portion has a maximum distance downstream from the upstream edge at a rearmost point of the cylindrical rear wall section.

17. The sprinkler of claim 16 wherein the upstream portion includes a cylindrical front wall section that extends downstream a second distance less than the maximum distance.

18. The sprinkler of claim 17 wherein the cylindrical front wall section extends at least in part into an upper wall section that channels water toward the cylindrical rear wall section.

19. The sprinkler of claim 18 wherein the upper wall section includes a curved edge to transition water flow downstream.

* * * * *

UNITED STATES PATENT AND TRADEMARK OFFICE

CERTIFICATE OF CORRECTION

PATENT NO. : 7,677,474 B2
APPLICATION NO. : 11/186687
DATED : March 16, 2010
INVENTOR(S) : Kevin J. Markley, Douglas Scott Richmond and Steven K. Sharp It is certified that error appears in the above-identified patent and that said Letters Patent is hereby corrected as shown below:

IN THE CLAIMS:

Column 11, line 33, in claim 8, after “tapered” insert --portion--.

Column 12, line 26, in claim 13, after “tapered” insert --portion--.

Signed and Sealed this
Fifth Day of May, 2015

Michelle K. Lee

Michelle K. Lee
*Director of the United States Patent and Trademark Office*